US005821474A

United States Patent [19]

Olszok et al.

[11] Patent Number: 5,821,474

[45] Date of Patent: Oct. 13, 1998

[54] MUFFLER WITH VARIABLE DAMPING CHARACTERISTICS

[75] Inventors: Thomas Olszok, Landau; Frieder Kunz; Bernd Fuhrmann, both of Neustadt, all of Germany

[73] Assignee: Heinrich Gillet Gmbh & Co. KG, Edenkoben, Germany

[21] Appl. No.: 738,059

[22] Filed: Oct. 25, 1996

[30] Foreign Application Priority Data

Nov. 2, 1995 [DE] Germany ..... 195 40 716.4

[51] Int. Cl.[6] ..... F01N 1/00

[52] U.S. Cl. ..... 181/254

[58] Field of Search ..... 181/226, 237, 181/241, 254, 264, 265, 269, 272, 282

[56] References Cited

U.S. PATENT DOCUMENTS 2,072,372 3/1937 Kingsley ..... 181/237
3,620,330 11/1971 Hall .
4,484,659 11/1984 Buchwalder ..... 181/237 X
5,614,699 3/1997 Yashiro et al. ..... 181/254

FOREIGN PATENT DOCUMENTS 0343607 11/1989 European Pat. Off. .
9405771 10/1994 Germany .
62-237175 10/1987 Japan .

*Primary Examiner*—Khanh Dang
*Attorney, Agent, or Firm*—Cohen, Pontani, Lieberman, Pavane

[57] ABSTRACT

A muffler and an actuating cell provided so that the acoustic properties of the muffler can be changed. The pressure drop in the muffler is fed to the actuating cell as a control pressure. The actuating cell has a plurality of chambers which are separated by diaphragms. Each diaphragm is supported by a spring and each chamber has a pressure connection. A first pressure line feeds the total gas pressure to the overpressure side of the first diaphragm. Another pressure line directs the static gas pressure to the low-pressure side of this diaphragm. Attached to the diaphragm is a piston rod which carries a valve closing element which closes or opens a gas feed pipe.

11 Claims, 5 Drawing Sheets

MUFFLER WITH VARIABLE DAMPING CHARACTERISTICS

BACKGROUND OF THE INVENTION

1. Field of the Invention

The invention is directed to mufflers with variable damping characteristics for pulsing gases.

2. Description of the Prior Art

A muffler of this type is known from German reference DE-U 94 05 771. This muffler uses a valve disk to open and close a pipe guiding the pulsing exhaust gases. The valve disk is fastened to a piston rod executing a linear movement. The piston rod itself is fastened to the diaphragm of a pressure sensor. The pressure within the interior of the muffler is fed to the overpressure side of the diaphragm, preferably via a pressure line that is integrated in the piston rod. A pressure spring supports the diaphragm relative to the overpressure. The low-pressure side of the diaphragm communicates with the atmosphere via a housing opening.

This arrangement is selected so that the valve disk closes the gas-conducting pipe in the neutral or rest state. The rest state corresponds to a slight overpressure in the muffler relative to atmospheric pressure. If the internal pressure in the muffler increases as the result of an increase in the throughflow of gas, the force generated by the overpressure moves the diaphragm against the sum of the forces of the support springs and atmospheric pressure, and the valve disk releases the exhaust pipe which was closed up to that point.

Since every muffler, due to the given constructional factors, has a very specific flow resistance which must determine the individual threshold value of the overpressure at which the valve disk starts to move, the support springs must be adapted accordingly. This makes the construction very costly. Further, it has been shown that in some cases, e.g., if the gas-conducting pipe is to be closed rather than opened when the pressure threshold is exceeded, operating errors can occur in practice when the muffler is used in a motor vehicle whose engine control cuts off the fuel supply as well as the air supply in intermittent or coasting operation.

SUMMARY OF THE INVENTION

Accordingly, it is an object of the present invention to improve a muffler of the above-mentioned type so that a large number of influencing variables can be taken into account while nevertheless maintaining the simple fundamental principle, in particular the elimination of an external control device and the use of a simple, reliably operating mechanism.

Pursuant to this object, and others which will become apparent hereafter, one aspect of the present invention resides in a muffler having an actuating cell including a plurality of diaphragms, a plurality of chambers and a plurality of pressure connections, for actuating the closing element at the piston rod. In principle, the number of chambers, and accordingly the number of control pressures which may be taken into consideration, is optionally large, although in practice this is inevitably limited in that the maximum excursion of a diaphragm is mechanically defined. The essential advantage of the present invention is that the total pressure is supplied to the overpressure side of a diaphragm, preferably a first diaphragm, and the static pressure of the muffler is delivered to the low-pressure side of this diaphragm. The different flow resistances of the various types of mufflers and of dampers which may possibly be arranged downstream are accordingly compensated for and the support spring need now only be adapted to the flow velocity at which the valve closing element opens or closes the gas-conveying pipe.

Additional control pressures can be applied thanks to the multiplicity of diaphragms and chambers. For example, the vacuum can be taken from the intake system of an internal combustion engine and directed into one of the chambers of the actuating cell. In this way, it is possible to force the valve closing element to occupy a determined, functionally appropriate position during the coasting operation of an internal combustion engine.

If necessary for operation, the present invention also offers the possibility that a chamber of the actuating cell communicates with the atmosphere via a housing bore hole. In this way, the barometric pressure which drops with rising altitude above sea level can be included in the control of the valve closing element.

The effect of a determined pressure value on the opening and closing characteristic of the valve closing element can be varied by changing the corresponding diaphragm surface.

Also, different effects can be achieved with respect to acoustical properties and the guiding of gas within the interior of the muffler by different constructions of the valve closing element.

According to a first embodiment of the invention, the valve closing element is a disk such as that known from DE-U 94 05 771 which was cited above. This disk serves to close the end of a gas-conveying pipe.

According to a further embodiment, two such valve disks are arranged on the piston rod. These valve disks can have different diameters and/or different orientation. In the latter case, they afford the possibility of closing and opening, respectively, a first gas-conveying pipe in the rest state and a second gas-conveying pipe in the active state.

An alternative construction of the valve closing element consists in a hollow cylinder which is moved in the exhaust-conveying pipe to close and open, respectively, perforated pipe regions or branched pipes, e.g., the throat of a Helmholtz resonator.

A third embodiment likewise uses a cylinder, although this cylinder has a closed bottom so that the flow of gas through the pipe in which the cylinder moves can also be cut off in its entirety.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
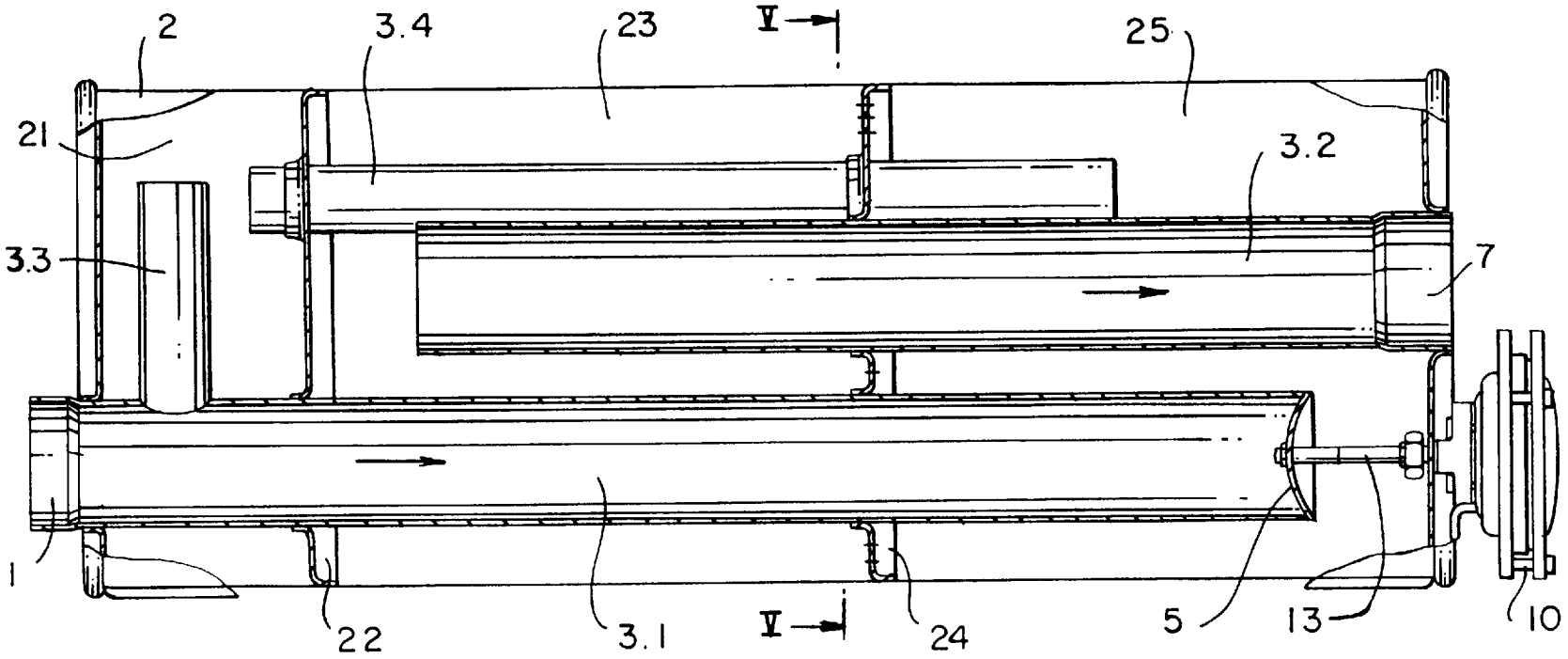
FIG. 1 PRIOR ART
FIG. 1 shows a conventional muffler with a valve disk for opening and closing an exhaust-conveying pipe, actuated by an aneroid diaphragm.

FIG. 1 shows a muffler with variable damping characteristics according to the prior art. The muffler has a housing 2 whose interior is divided into three chambers by two dividing walls 22, 24. An exhaust feed pipe 3.1 leads into the housing 2 from a gas inlet 1 and an exhaust outlet pipe 3.2 leads out of the housing 2 at a gas outlet 7. The end of the feed pipe 3.1 is closed by means of a valve disk 5.

The valve disk 5 is connected to a piston rod 13 which is part of an aneroid diaphragm actuating cell 10.

If the end of the feed pipe 3.1 is blocked as is shown in FIG. 1, the exhaust gas flows, via a branch pipe 3.3, into a first expansion chamber 21 in the housing 2, through another gas pipe 3.4 into a third expansion chamber 25, and through perforations in the dividing wall 24 into the second expansion chamber 23 where it enters the outlet pipe 3.2 so as to exit the housing 2 at the gas outlet 7.

If the end of the feed pipe 3.1 is open, the exhaust gas, because of the low flow resistance, flows directly into the third expansion chamber 25, through the perforations in the dividing wall 24 into the second expansion chamber 23 and out of the sound damper housing 2 through the exhaust pipe 3.2.

Figure 2:
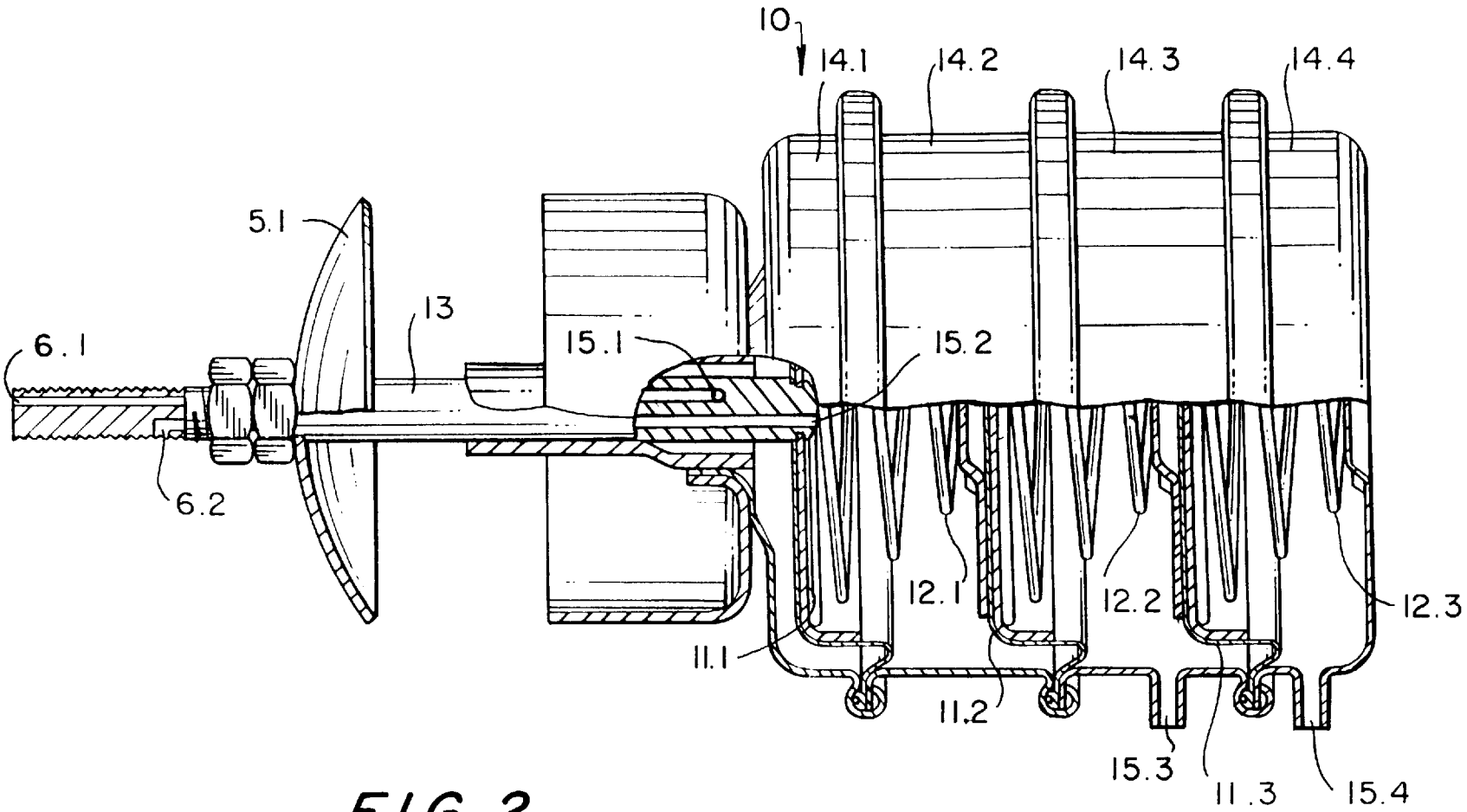
FIG. 2 shows an actuating cell with four chambers and three diaphragms.

FIG. 2 shows an enlarged view in half-section of an actuating cell 10 with four chambers 14.1, 14.2, 14.3, 14.4 which are separated by three membranes or diaphragms 11.1, 11.2, 11.3, each of which is supported by a support spring 12.1, 12.2, 12.3. At least one of the diaphragms has a divergent or deflecting surface, and each of the four chambers 14.1 . . . 14.4 has its own pressure connection 15.1, 15.2, 15.3, 15.4. The piston rod 13 is connected with the foremost diaphragm 11.1. A valve disk 5.1, for example, is attached to the foremost diaphragm 11.1 as a closing element.

The piston rod 13 has two bore holes. These bore holes lead to pressure connections 15.1, 15.2 in front of and behind the first diaphragm 11.1. One pressure line 6.1 opens out at the head of the piston rod 13 and receives the total gas pressure. The other pressure line 6.2 opens out laterally in the piston rod 13 at a sufficient distance from the head of the piston rod 13 and from the valve disk 5.1 and receives the static pressure in the interior of the sound damper. In this way, the first diaphragm 11.1 is acted upon only by the difference between these two pressures which is proportional to the square of the flow velocity of the exhaust gases. The individual flow resistance of the respective muffler is compensated for. The strength of the support spring 12.1 can therefore be adapted exclusively to the flow velocity of the exhaust gases at which the valve disk 5.1 should open.

Other control pressures can be connected to the pressure connections 15.3, 15.4 of the other chambers 14.3, 14.4. For example, a vacuum can be applied to the third chamber 14.3 from the intake system of an internal combustion engine in order to compel a determined position of the valve disk 5.1 when the throttle is closed, i.e., during coasting operation.

The fourth chamber 14.4 can continue to communicate with the atmosphere, for instance, via its pressure connection 15.4 so that the atmospheric pressure which decreases with increasing altitude above sea level can be included in the control characteristics in this way.

In principle, the actuating cell 10 can, of course, be constructed with additional chambers, pressure connections, diaphragms and support springs if necessary and the diaphragms can be constructed for the deflections which would then be required.

In order to influence the force exerted by a determined pressure, it is advisable to vary the diaphragm surfaces, but to leave the spring characteristics unchanged.

Figure 3:
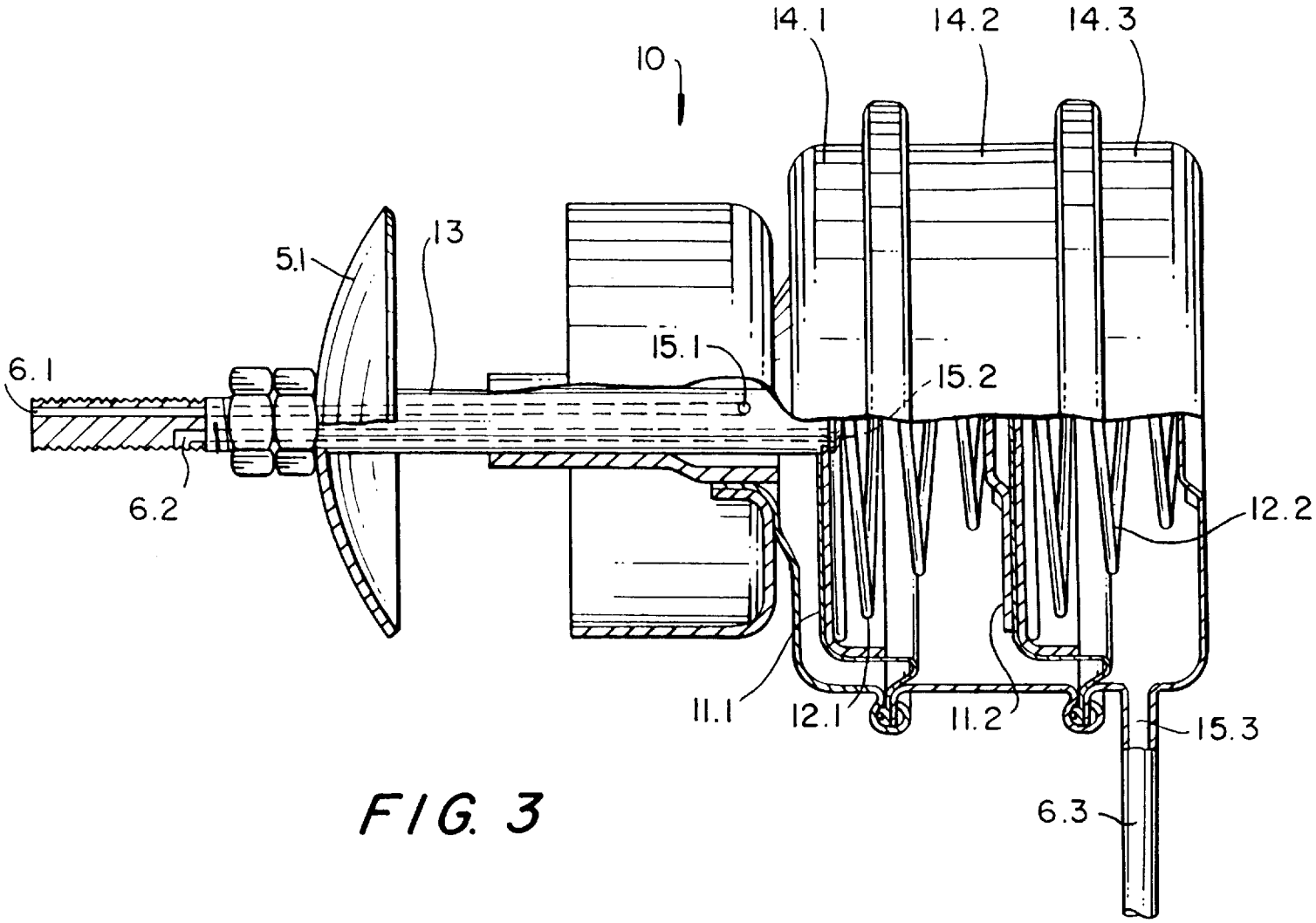
FIG. 3 shows an actuating cell with three chambers and two diaphragms.

FIG. 3 shows an embodiment of an actuating cell 10 with three chambers 14.1 . . . 14.3 and two diaphragms 11.1, 11.2. As was already mentioned, the two foremost chambers 14.1, 14.2 are provided with pressure by the pressure lines 6.1, 6.2 which are integrated in the piston rod 13. An external pressure line 6.3 is connected to the third chamber 14.3.

Figure 4:
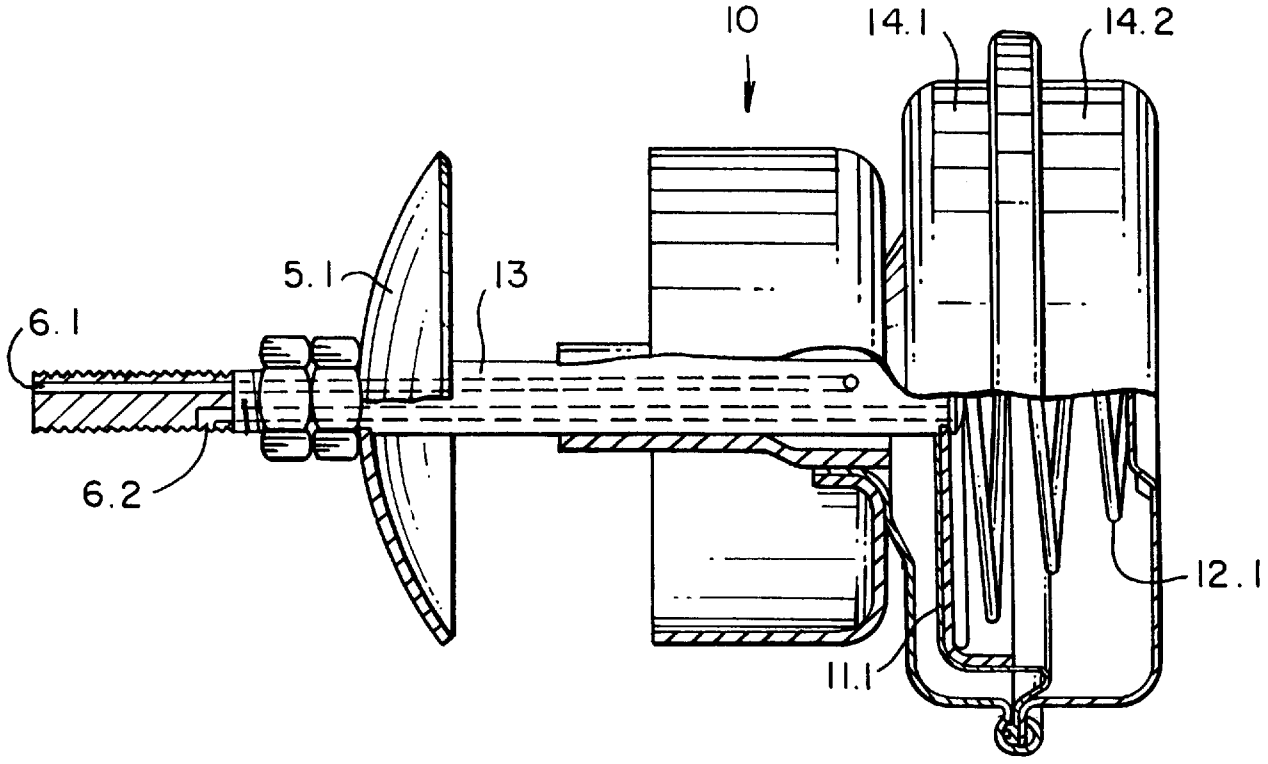
FIG. 4 shows an actuating cell with two chambers and a diaphragm.

FIG. 4 shows an embodiment with only two chambers 14.1, 14.2 and a diaphragm 11.1. Both chambers 14.1, 14.2 are supplied via the pressure lines 6.1, 6.2 integrated in the piston rod 13. The actuating cell 10 has no external pressure connections in this embodiment, which particularly simplifies manufacture and eliminates the risk that exhaust gas will exit the sound damper housing in an undesirable manner.

Figure 5:
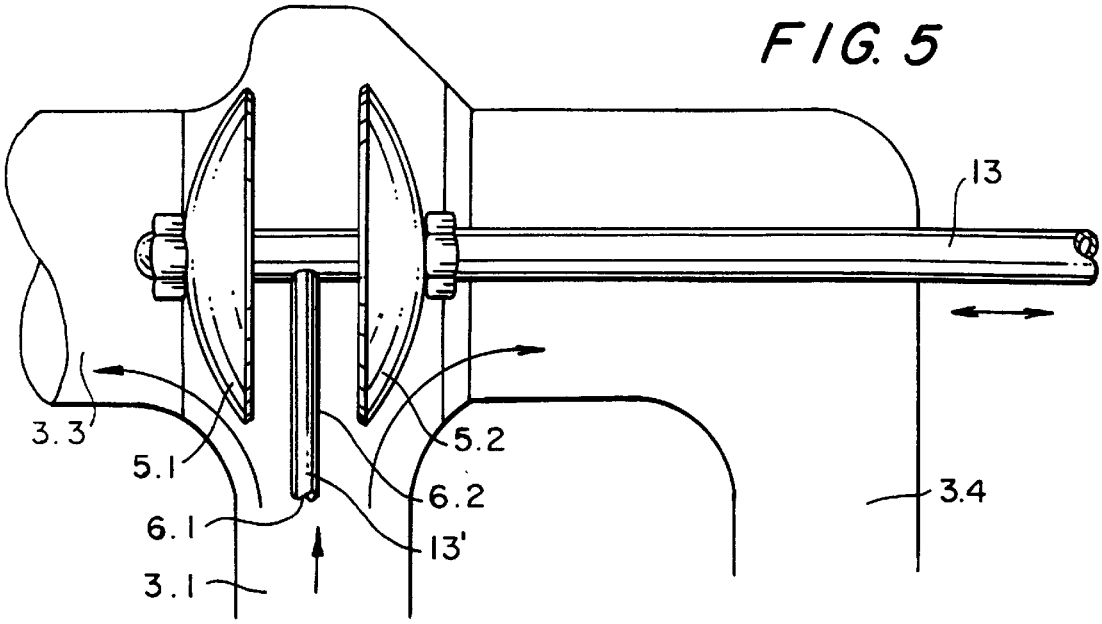
FIG. 5 shows an embodiment of a closing element with two valve disks.
Figure 6:
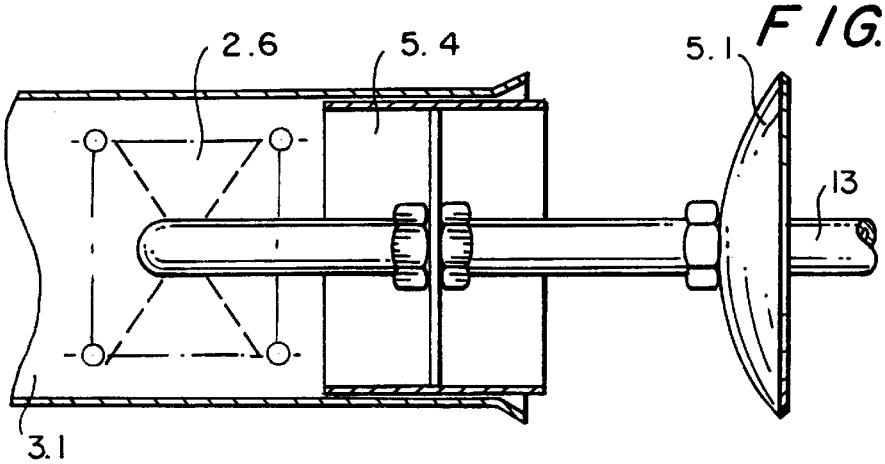
FIG. 6 shows an embodiment of a closing element with hollow cylinder and valve disk.
Figure 7:
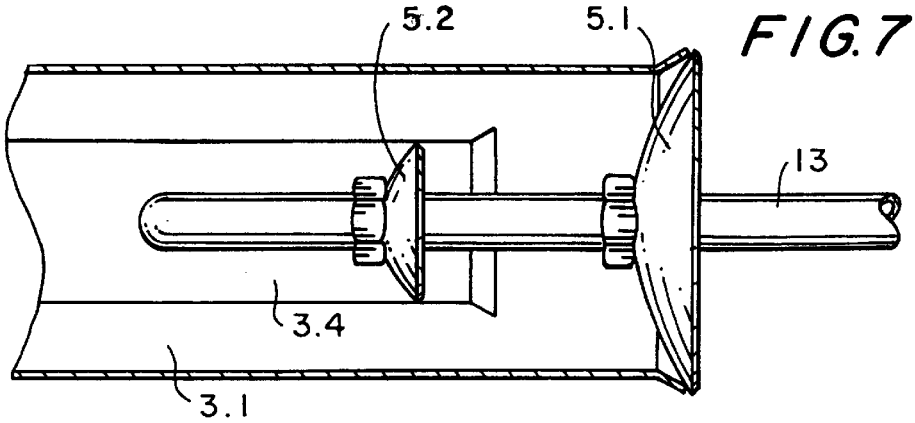
FIG. 7 shows an embodiment of a closing element with two valve disks with different diameters.

Since a simple valve disk which closes or opens the end of a pipe is far from adequate to fully exploit the many possibilities offered by the actuating cell with its plurality of chambers, pressure connections, diaphragms and support springs, schematic application examples are shown in FIGS. 5 to 7 which enable a much more varied influencing of the acoustics and gas flows in the interior of the muffler.

FIG. 5 shows two valve disks 5.1, 5.2 which are oriented in a mirror-inverted manner relative to one another on the piston rod 13. Each valve disk 5.1, 5.2 opens or closes a pipe associated with it. The gas flowing in through the feed pipe 3.1 flows to the left and/or to the right depending on the position of the two valve disks 5.1, 5.2. In order to pick up the pressure ratios in the feed pipe 3.1 the piston rod 13 is provided with a lateral projection 13', the pressure line 6.1 for the total pressure opens out at the head of this projection 13' and the pressure line 6.2 for the static pressure opens out at its side.

FIG. 6 shows a second example. Here, a valve disk 5.1 for opening and closing the gas feed pipe 3.1 is provided at the piston rod 13, and a hollow cylinder 5.4 is situated in front of the disk. The gas pipe 3.1 is provided with a perforated region 2.6 which is closed to varying degrees of tightness by the cylinder 5.4 in order to influence the acoustics of the sound damper. A cylinder with a closed bottom can also be used.

FIG. 7 shows a third example in which two valve disks 5.1, 5.2 with different diameters are arranged at the piston rod 13. These valve disks 5.1, 5.2 correspond to two concentric pipes 3.1, 3.4. The second valve disk 5.2 can be moved in the interior of the second pipe 3.4 until the first valve disk 5.1 closes the outer gas-conveying pipe 3.1. Of course, the two valve disks 5.1, 5.2 can also be dimensioned and positioned in such a way that the first valve disk 5.1 can be displaced inside the first pipe 3.1, while the second valve disk 5.2 closes or opens the end of the second gas pipe 3.4.

The invention is not limited by the embodiments described above which are presented as examples only but can be modified in various ways within the scope of protection defined by the appended patent claims.

We claim:

1. A muffler with variable damping characteristics for pulsing gases, comprising: a housing; a gas feed pipe mounted to the housing; a plurality of pipes mounted in the housing so as to be in fluid communication with the gas feed pipe; and actuating means mounted to the housing and including an actuating cell having a plurality of chambers which are separated by diaphragms, a plurality of springs, one of the springs being respectively mounted at each diaphragm so as to support the respective diaphragm, each chamber being configured to have a pressure connection the actuating cell further having a piston rod, a valve disk closing element mounted to the piston rod, a first pressure line which directs total gas pressure to an overpressure side of the diaphragm and a second pressure line which directs static gas pressure to a low-pressure side of the diaphragm, the valve disk being movably arranged in one of the pipes, the actuating means being operative to move the valve disk to control gas flow in the one pipe.

2. A muffler according to claim 1, wherein the first and second pressure lines are formed in the piston rod, the first pressure line being arranged to open out at a head of the piston rod, the second pressure line being arranged to open out laterally in the piston rod at a distance from the head of the piston rod and at a distance from the valve disk.

3. A muffler according to claim 1, and further comprising a third pressure line arranged to feed a vacuum to a chamber of the plurality of chambers, the vacuum originating from the intake system of an internal combustion engine.

4. A muffler according to claim 1, wherein one of the chambers is configured to communicate with the atmosphere.

5. A muffler according to claim 1, wherein at least one of the diaphragms has one of a divergent surface and a deflecting surface.

6. A muffler according to claim 1, wherein the valve disk closing element includes at least one valve disk.

7. A muffler according to claim 6, wherein at least two valve disks are mounted to the piston rod, the valve disks having diameters that differ from one another.

8. A muffler according to claim 6, wherein at least two valve disks are mounted on the piston rod so as to be oriented in a mirror-inverted manner relative to one another.

9. A muffler according to claim 1 wherein the valve disk closing element is formed as a hollow cylinder.

10. A muffler according to claim 1, wherein the valve disk closing element is formed as a cylinder with a closed bottom.

11. A muffler according to claim 9, wherein one of the pipes in the housing is a gas feed pipe having perforations therein, the hollow cylinder being arranged in the gas feed pipe so as to be slidable over the perforations.

* * * * *